US006993857B2

(12) United States Patent
Coles et al.

(10) Patent No.: US 6,993,857 B2
(45) Date of Patent: Feb. 7, 2006

(54) MILLING AND DRYING APPARATUS INCORPORATING A CYCLONE

(75) Inventors: Graeme Douglas Coles, Christchurch (NZ); Andrew James Rafferty, deceased, late of Christchurch (NZ); by Karen Millicent Rafferty, legal representative, Christchurch (NZ)

(73) Assignee: Eco Technology International (2000) Limited, Christchurch (NZ)

( * ) Notice: Subject to any disclaimer, the term of this patent is extended or adjusted under 35 U.S.C. 154(b) by 68 days.

(21) Appl. No.: 10/362,408

(22) PCT Filed: Aug. 29, 2001

(86) PCT No.: PCT/NZ01/00177

§ 371 (c)(1),
(2), (4) Date: Feb. 24, 2003

(87) PCT Pub. No.: WO02/18057

PCT Pub. Date: Mar. 7, 2002

(65) Prior Publication Data

US 2004/0040178 A1 Mar. 4, 2004

(30) Foreign Application Priority Data

Aug. 29, 2000 (NZ) ..... 506609

(51) Int. Cl.
*F26B 17/00* (2006.01)

(52) U.S. Cl. ..... 34/592; 34/589; 34/591; 432/15; 432/58; 432/106

(58) Field of Classification Search ..... 34/589, 34/591, 593, 586, 592; 432/15, 58, 106; 110/245

See application file for complete search history.

(56) References Cited

U.S. PATENT DOCUMENTS

| | | | | |
|---|---|---|---|---|
| 2,717,695 | A * | 9/1955 | Martin | 209/732 |
| 4,414,112 | A * | 11/1983 | Simpson et al. | 210/512.1 |
| 4,431,405 | A * | 2/1984 | Eatherton | 432/72 |
| 4,789,476 | A | 12/1988 | Schulz | |
| 4,992,043 | A * | 2/1991 | Lockwood, Jr. | 432/58 |
| 6,206,202 | B1 | 3/2001 | Galk et al. | |

FOREIGN PATENT DOCUMENTS

| | | |
|---|---|---|
| WO | WO 85/01454 | 4/1985 |

* cited by examiner

*Primary Examiner*—Jiping Lu
(74) *Attorney, Agent, or Firm*—McCormick, Paulding & Huber LLP

(57) ABSTRACT

A cyclone which includes an upper cylindrical portion opening into the wider end of a lower frustro-conical portion, with a primary air inlet such that the inlet air is substantially tangential to the circumference of the cyclone, and an exhaust outlet at or adjacent the top of the cylindrical portion; a control valve is associated with the exhaust outlet and can be used to partially or completely shut off the outlet; a secondary air inlet is associated with the narrow end of the frustro-conical portion and is provided with an air flow stabilising device adapted to admit a stream of air substantially along the longitudinal axis of the cyclone; also including means for withdrawing processed product from the frustro-conical portion.

14 Claims, 3 Drawing Sheets

MILLING AND DRYING APPARATUS INCORPORATING A CYCLONE

TECHNICAL FIELD

The present invention relates to milling and drying apparatus which incorporates a cyclone, and to methods of operation of such apparatus.

BACKGROUND OF THE INVENTION

The use of a cyclone to separate, mill, or dry material is known, and various applications of cyclones have been described in a number of prior art specifications. For example, U.S. Pat. No. 5,236,132 (Rowley) discloses a comminutor/dehydrator which incorporates a cyclone, as does U.S. Pat. No. 4,390,131 (Pickrel). U.S. Pat. No. 4,743,364 and No. 6,206,202 both disclose classifying/separating apparatus incorporating a cyclone. However, the prior art designs in general fail to provide fine control of processing conditions within the cyclone. This in turn limits the range of products which can be processed, and also limits the quality of the output product. Further, most if not all of the known comminuting/dehydrating cyclones operate only batch processes.

OBJECT OF THE INVENTION

It is an object of the present invention to provide apparatus which incorporates a cyclone and which is capable of continuously milling and/or drying a large range of different products with fine control over the particle size/moisture content of the output product.

DISCLOSURE OF INVENTION

The present invention provides a cyclone comprising an upper cylindrical portion which opens into the wider end of a lower frustro-conical portion, with the longitudinal axes of said upper and lower portions aligned;

a primary air inlet into the cyclone arranged such that the inlet air is substantially tangential to the circumference of the cyclone;

an exhaust outlet at or adjacent the top of the cylindrical portion;

a control valve associated with said exhaust outlet and capable of partially or completely shutting off said exhaust outlet;

a secondary air inlet associated with the narrow end of the frustro-conical portion and provided with an air flow stabilising device which is adapted to admit a stream of air substantially along the longitudinal axis of the cyclone;

means for withdrawing processed product from the cyclone.

Preferably, said air flow stabilising device is moveable into and out of the narrow end of the frustro-conical portion and has an outer wall which is frustro-conical in shape and an interior bore through which air is supplied in use; said air flow stabilising device being dimensioned and arranged such that the narrow end of said frustro-conical outer wall is insertable in the narrow end of said frustro-conical portion of the cyclone.

The means of withdrawing the process product may be an annular gap at the narrow end of the frustro-conical portion between the wall of the frustro-conical portion and the air flow stablising device. However, another possibility is that means of withdrawing processed product are provided in the form of one or more outlets formed in the wall of the frustro-conical portion of the cyclone.

Preferably, the cyclone further comprises a cylindrical core mounted within the upper cylindrical portion of the cyclone, with the longitudinal axis of the cylindrical core parallel to, or coincident with, the longitudinal axis of said upper cylindrical portion.

The present invention further provides milling and drying apparatus incorporating at least one cyclone, as described above, said apparatus further including;

a product inlet device arranged to supply product to be processed in the cyclone into the air supplied to either the primary or the secondary air inlets;

an air supply means connected to the primary air inlet and to the secondary air inlet;

air heating means adapted to heat air supplied to, and/or air supplied from, said air supply means;

means for recycling all or part of the air exhausted from the cyclone through the exhaust outlet to said air supply means.

Preferably said means for recycling incorporates at least one monitor for measuring the humidity and the temperature of the air exhausted from the cyclone, and a valve for adjusting the proportion of the exhaust air directed to the air supply means in response to the monitor readings.

BRIEF DESCRIPTION OF THE DRAWINGS

By way of example only, preferred embodiments of the present invention are described in detail with reference to the accompanying drawings, in which.

BEST MODE FOR CARRYING OUT THE INVENTION

Figure 1:
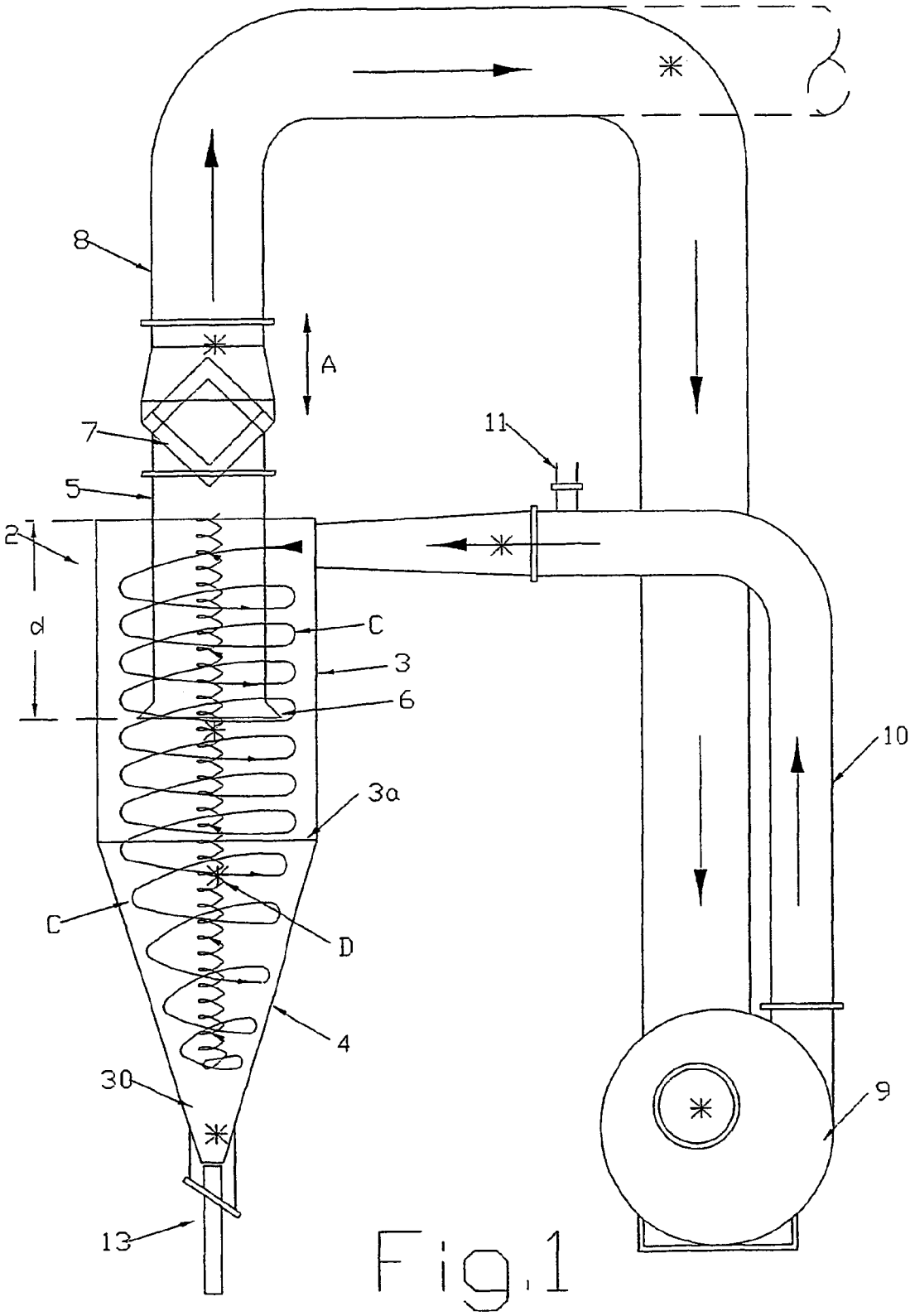
FIG. 1 is a diagrammatic side view of apparatus in accordance with the present invention.
Figure 2:
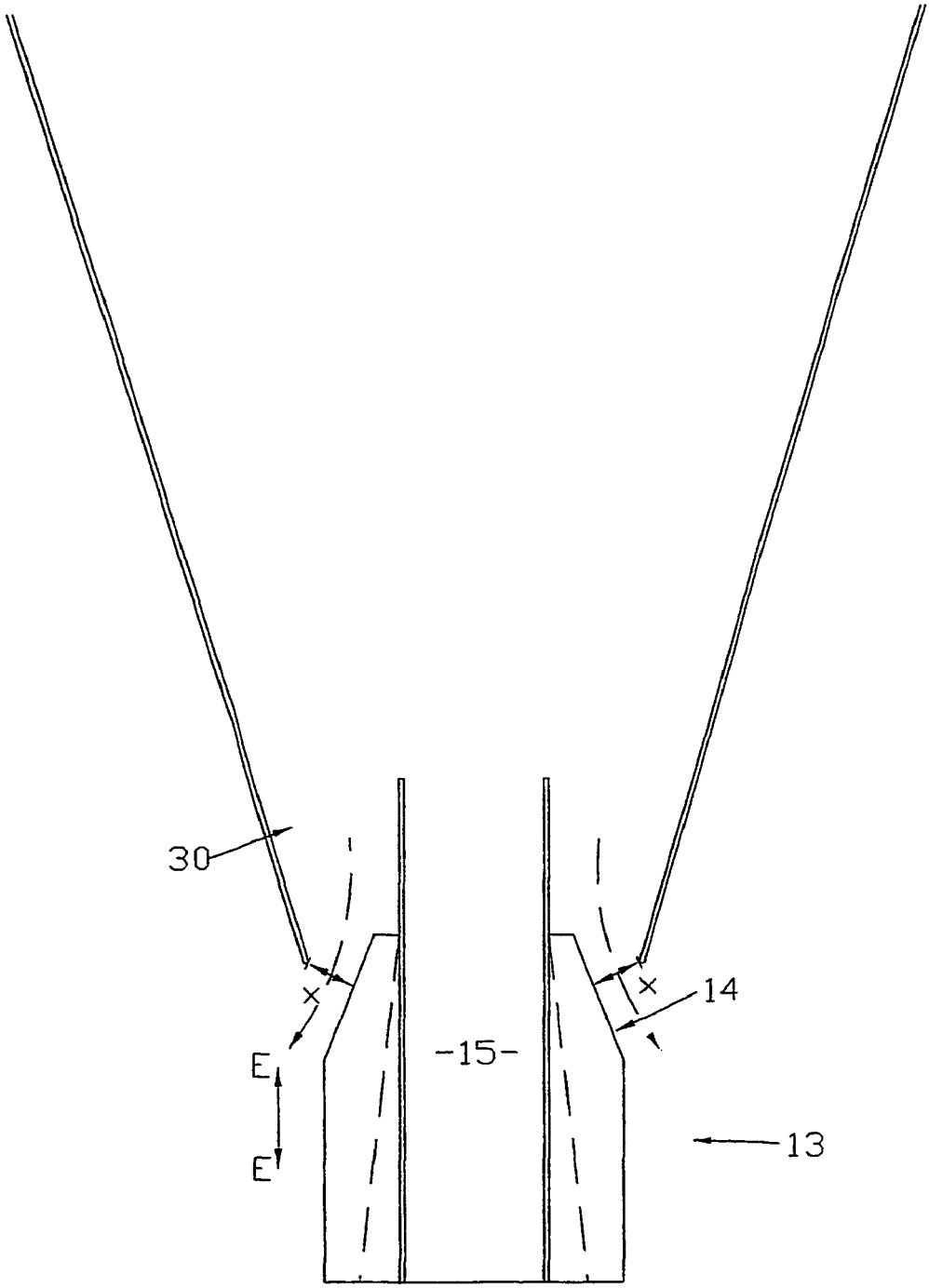
FIG. 2 is a view of the lower portion of FIG. 1 on a larger scale.

Referring in particular to FIGS. 1 and 2, a cyclone 2 comprises an upper cylindrical portion 3, the lower end 3*a* of which opens into the upper end of a frustro-conical portion 4, which is arranged coaxially with the cylindrical portion and with the smaller end lowermost. The longitudinal axis of the cyclone 2 is substantially vertical.

A cylindrical core 5 is mounted in the top of the cylindrical portion 3, with the longitudinal axis of the core 5 coaxial with the longitudinal axis of the portion 3. The upper end of the core 5 projects from the top of the cylindrical portion 3, which is otherwise closed. The lower nd of the core 5 is formed with a flared portion 6, the length of which is adjustable. The distance by which the core 5 projects into the cylindrical portion 3 can be adjusted using any suitable known means, (e.g. screw adjusters or hydraulic rams (not shown)).

When the cyclone is in operation, the core 5 physically separates the relatively hot, dry exhaust gases from the relatively cool and wet inlet air and entrained product. In addition, the core 5 acts as a heat exchanger:—the core is heated by the exhaust gases, and this is transferred to the relatively cool inlet air by conduction, convection and radiation. This effect is particularly marked at relatively low inlet air velocities.

The more the core 5 is lowered down the cylindrical portion 3, the greater the volume of air and entrained material in the area between the top of the portion 3 and the flange 6. This gives an increase in dwell time which can be useful for ensuring complete processing, especially when the inlet air through the duct 10 has a relatively low velocity and/or when very fine materials are being processed. The above described retention effect is increased by enlarging the outer diameter of the flange 6.

A conical valve 7 is mounted at the top end of the cylindrical core 5 and can be raised or lowered in the direction of arrows A to partially or completely close off the top of the core 5. The more the top of the core 5 is closed off, the greater the backpressure in the cyclone and in particular, the greater the pressure in the inner vortex, as hereinafter described.

The top end of the cylindrical core 5 opens into an exhaust duct 8, the other end of which may be vented to atmosphere and/or connected to the inlet of a blower or fan 9, as more particularly described with reference to FIG. 3. The outlet of the blower 9 is connected to an air inlet duct 10 which opens into the side wall of the cylindrical portion 3, adjacent the top of that portion.

The delivery side of a product inlet device 11 opens into the air inlet duct 10. The device 11 may be of any suitable known type, (e.g. a rotary valve for solids or an injection nozzle for liquids) and is in communication with a source of the product to be processed in the cyclone, such as a feed hopper (not shown in FIG. 1). When the device 11 is open, product to be processed flows through the valve, is entrained in the stream of air passing through the air inlet duct 10, and is swept into the upper part of the cyclone 2.

The air and entrained product coming into the cyclone from the duct 10 is admitted approximately tangentially to the circumference of the cylindrical portion 3, and preferably as close to the top of the cylindrical portion 3 as possible, so that product has a maximum dwell time within the cyclone. Once inside the cyclone, the air and entrained product initially follow a spiral path around the inner walls of the cyclone, as indicated by arrows C, spiraling around the cyclone down towards the narrow end of the frustro-conical portion 4. This forms a relatively high-pressure first vortex adjacent the walls of the cyclone. Adjacent the narrow end of the frustro-conical portion 4, a reverse spiral flow forms a second vortex (as indicated by arrows D) which extends from point adjacent the lower end of the cyclone to the top of the cyclone, approximately along the longitudinal axis of the cyclone.

This pattern of airflow within the cyclone produces a relatively stable pattern of velocity and pressure variations across the width of the cyclone, i.e. in a substantially horizontal plane. The air velocity varies inversely with the air pressure. It will be appreciated that the actual air velocities and pressure at any given point depend upon the air inlet velocity and pressure and the dimensions of the cyclone, but once the cyclone is in operation and the pattern of air flow is established, there is a consistent horizontal pattern of a low velocity/high-pressure zone immediately adjacent the cyclone walls, then the area of the first vortex, which is high velocity and correspondingly low pressure, then a transition zone between the first and second vortices, in which the air velocity gradually drops, reaching zero at the interface between the two vortices, and then increases (reversed in direction) towards the core of the second vortex, with the pressure varying inversely to the velocity.

The entrained product does not move in a smooth spiral around the cyclone:—the particles of the product impact upon each other and upon the walls of the cyclone; this has the effect of comminuting/milling the product, and is the main comminuting effect if the product being processed is noncellular. However, if the product is cellular, (e.g. fruit, vegetables, cereals, clays) then the main comminuting/milling effect is caused by the movement of the product between the high and low pressure in areas described above:—as the cellular particles move from a high pressure area to a lower pressure area, the material on the outside of the particle tends to spall under the pressure differential. Further, any water contained in the particles evaporates rapidly as the particle moves to a lower pressure zone; this evaporation may be sufficiently rapid to "explode" the particle. As the particles break down, more of the particle surface is exposed, and this of course facilitates further evaporation.

The final particle size of the product depends upon the inlet velocity of the air into the cyclone, the dwell time of the product in the cyclone, and the nature of the product itself:—obviously, some products are more brittle than others and fracture more readily under impact.

The product is dried by tumbling in the air stream, causing evaporation both of surface moisture and of moisture contained within the product, as described above. The rate of drying is governed by the air temperature and humidity and by the rate at which the product is comminuted:—a product which breaks up rapidly into small particles is dried more rapidly, since the drying air can contact the greater surface area of the product.

Although hot air obviously will dry more effectively than cooler air, for a majority of organic products i is advantageous to keep the temperature of the product as low as possible, preferably no higher than 50° Centigrade. Although the inlet air temperature is typically in the range 70–85° Centigrade, evaporative cooling of the product plus the very short dwell time in the cyclone (typically 0.1 second for relatively dry product up to about three or four seconds for very wet product) helps to keep the heating of the product to a minimum:—typically, the exit temperature of the product is about 35° Centigrade. Temperature sensors marked by * in FIG. 1 measure the temperature at the following places:

a) inlet of the blower 9
b) in the duct 10
c) at the start of the exhaust duct 8
d) midway along the exhaust duct 8
e) at the base of the cyclone
f) at the mid-point of the cyclone
g) at the lower edge 6 of core 5.

The temperature of the exhaust air generally is higher than the inlet air temperature; due to the use of the cylindrical core 5 as a heat exchanger, this temperature differential is used to heat the inlet air, resulting in a high efficiency operation. It is believed that a possible explanation for the heating of the exhaust air is that water vapour evaporated from the product may be moved to the higher pressure areas of the cyclone due to the water vapour activity gradient. Effectively, such water vapour may b considered supercooled and if nucleation sites are present (provided for example by fine particles in the exhaust air), the water vapour will condense, releasing its heat evaporation which heats the surrounding air. It seems probable that this mechanism typically would occur inside the cylindrical core 5.

In conventional designs of cyclone, the position in the cyclone of the first and second vortices, and the level in the cyclone at which the airflow from the first vortex reverses to form the second vortex, tend to vary substantially during the period of operation of the cyclone:—the patterns of air movement are not stable, and the vortices precess about their average positions. However, for the cyclone to operate reliably and consistently, it is important that the vortices are as stable as possible, since their position governs the levels at which particles are deposited on the cyclone wall by the air stream, and also the size of particle which is deposited. Further, if the second vortex moves too close to the wall of the cyclone, it entrains some of the processed material which has been deposited there, and draws it into the exhaust system. This wastes processed material and also contaminates the exhaust gases.

It has been discovered that it is possible to stabilise the vortices by introducing a secondary flow of air into the lower end of the cyclone, using an airflow stabilising device 13 (which is shown on an enlarged scale in FIG. 2) to admit a secondary stream of air into the lower end of the cyclone, along the longitudinal axis of the cyclone. This secondary air stream may be at the same velocity and pressure as the primary air stream admitted through the inlet duct 10, or may be at a different velocity/pressure.

The airflow stabilising device 13 has a partly frustro-conical exterior 14 and a central cylindrical bore 15. The longitudinal axis of the bore 15 is aligned with the longitudinal axis of the cyclone 2. In an alternative construction shown in broken lines in FIG. 2, the bore 15 may be flared to produce a Venturi effect. The exterior 14 and the bore 15 can be advanced into or withdrawn from the end of the cyclone as indicated by arrows E, either together or independently of each other. An annular gap X is formed between the exterior wall of the frustro-conical portion 14 of the device 13 and the lower end of the cyclone. The size of the gap X may be varied by moving the device 13 towards or away from the cyclon.

The object of the airflow stabilising device 13 is to stabilise the vortices, particularly the second vortex, so that it does not substantially vary in position within the cyclone. This means that the second vortex will reliably pick up under-processed material from higher up the cyclone, but will not disturb the adequately processed material which has been deposited in the lower part of the cyclone. The natural patterns of airflow in the cyclone, as shown in FIG. 1, tend to produce a dead zone 30 in the lowermost part of the cyclone, adjacent the open lower end. For the cyclone to operate efficiently, the material deposited in the dead zone 30, which will in due course flow out of the lower end of the cyclone through the gap X, should be of the target particle size and density and degree of dryness. Further, any of the less dense and larger particles which have been deposited on the cyclone walls higher up the cyclone should be re-entrained in the airflow for further processing.

Without the airflow stabilising device 13, the material leaving the cyclone through the gap X tends to be very mixed in particle size, since the precessing of the second vortex means that some particles are over processed and some particles which require further processing fail to be re-entrained and end up in the dead zone.

The use of the airflow stabilising device 13 not only makes the establishment of the vortices much more reliable, but also makes the position of the second vortex adjustable: —the more the bore 15 is advanced into the base of the cyclone, the more the lower end of the second vortex is raised, and the larger the dead zone 30. Since the particles in the dead zone eventually will pass out of the gap X, this means that the particle size of the processed material is increased by advancing the bore into the base of the cyclone. Conversely, the more the bore 15 is withdrawn towards the position of FIG. 1, the smaller the dead zone 30, and therefore the smaller the particle size of the particles passing through the gap X.

The airflow stabilising device can be moved relative to the base of the cyclone during a processing run, but in general would be set up for recovery of a particular particle size at the start of a run.

Advancing the frustro-conical portion 14 of the device 13 further into the end of the cyclone will reduce the size of the annular gap X and thus slow the flow of product from the cyclone; withdrawing the frustro-conical portion 14 will increase the rate of flow of product from the cyclon. In operation, product tends to leave the annular gap X in spurts or batches due to the natural pulsing action of the cyclone. The size of the gap X is adjusted for the required particle size.

In general, it has been found that there is some airflow into the base of the cyclone through the gap X, causing some re-entrainment of product from the dead zone 30, but that this airflow is sufficiently low that the re-entrainment effect is not significant in practice.

For the apparatus to be used to maximum efficiency, and to enable a large variety of products to be processed under optimum conditions, it is necessary to be able to control the following variables accurately:

1. The velocity of the air introduced at the top of the cyclone through air inlet duct 10.

2. The volume of the air introduced at the top of the cyclone through air inlet duct 10. Items 1 and 2 are controlled by controlling the speed of the blower 9.

3. The air pressure within the cyclone. This is controlled by control of the speed of the blower 9 in combination with the adjustment of the conical valve 7, which controls the back pressure in the cyclone, and the pressure of the air admitted into the cyclone by the stabiliser device 13.

4. The humidity of the air introduced through air inlet duct 10.

5. The humidity of the air introduced through the airflow stabilising device 13. Items 4 and 5 may be controlled together or independently by monitoring the humidity of the exhaust air expelled through duct 8 and adjusting the mix of exhaust airatmospheric air supplied through the inlet duct 10 and to the stabiliser device 13 to achieve the required humidity.

6. The temperature at which drying takes place, i.e. the temperature inside the cyclone. This is controlled by adjusting the temperature of the air supplied through the inlet duct 10 and to the stabiliser device 13 and by providing the cyclone with more or less insulation, as required.

7. The moisture content and particle size of the final product. This is controlled by varying the input rate of the material to be processed through the device 11 in combination with the regulation of the pressure, velocity, temperature and humidity of the air supplied to the inlet duct 10 and to the stabiliser device 13, and the adjustment of the level of the lower end 6 of the control cone 5 relative to the lower edge 3*a* of the cylindrical portion 3.

In general, for given operating conditions, there is a fixed relationship between the particle size of the product after processing and its moisture content. However, if a higher moisture content is required without a change in the particle size, this can be achieved by closing down the conical valve 7 to reduce the amount of air vented to exhaust.

Figure 3:
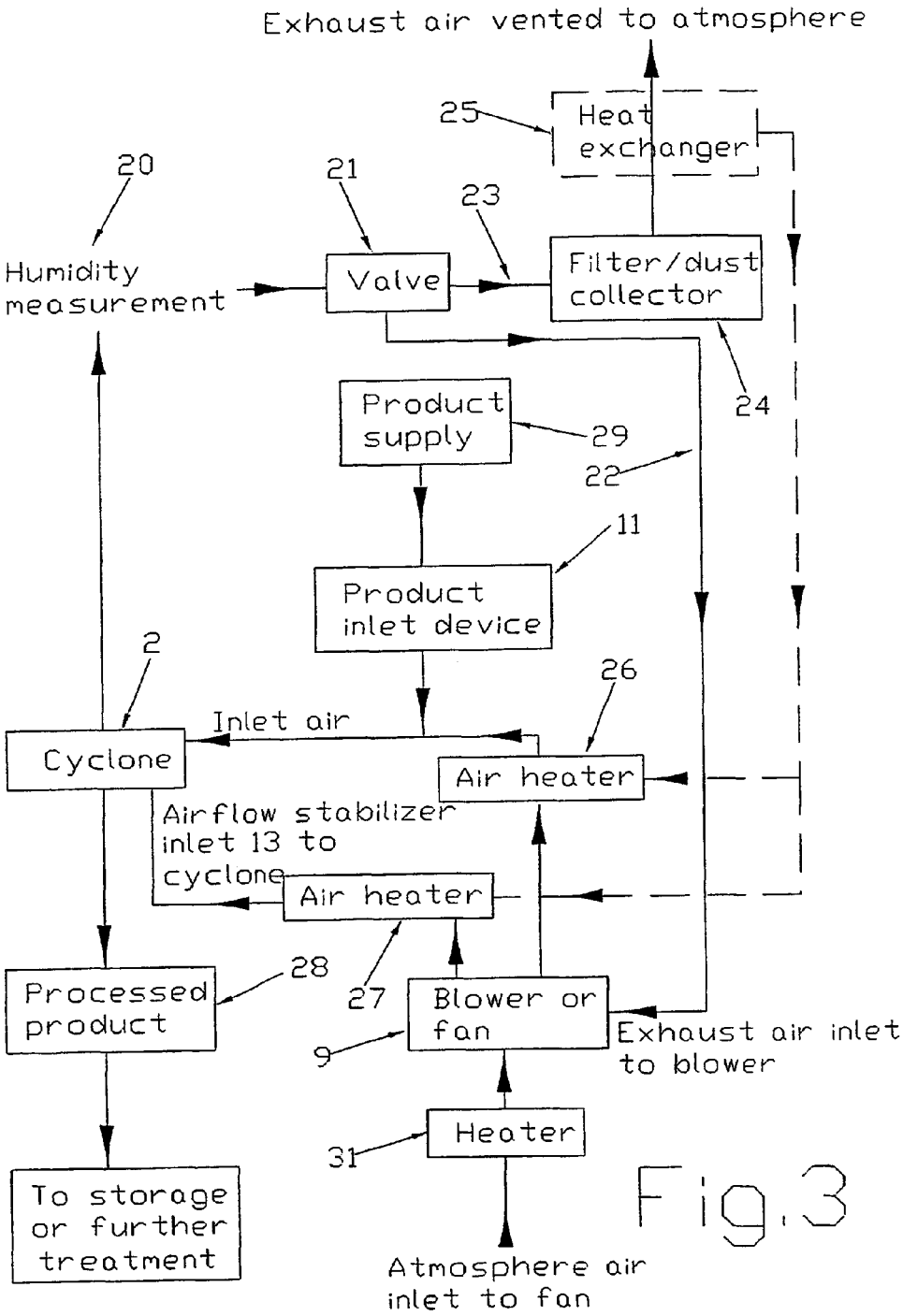
FIG. 3 is a flow diagram showing preferred methods of operation of the apparatus of the present invention.

FIG. 3 shows how the above described factors can be controlled independently to achieve optimum results for any specified product. It will be appreciated that any of the controllable factors may be manually controlled or may be centrally computer-controlled.

Referring to FIG. 3, the humidity of the exhaust air leaving the cyclone 2 through duct 8 is measured by a monitor 20 which controls a mixer valve 21. The mixer valve 21 directs a proportion of the exhaust air either to a line 22 leading to the inlet of the blower 9 or to a line 23 which is connected to a filter and/or dust collector 24 and optionally to a heat exchanger 25. A second filter and/or dust collector (not shown) may be connected between the valve 21 and the blower 9; however, this is not always necessary. Depending upon the desired humidity of the air in the cyclone, the valve 21 adjusts the proportion of the exhaust air which is directed to the inlet of the blower 9 or vented to atmosphere via the filter 24 and heat exchanger 25.

Heat from the heat exchanger 25 can be supplied to either or both of the air heaters 26, 27 which can be used to heat respectively the inlet air supplied by the blower 9 to the inlet duct 10 and the air supplied by the blower 9 to the airflow stabilising device 13.

Sensors (not shown) inside the cyclone 2 record the pressure and humidity in the operating zones of the cyclone.

The blower 9 has separate outputs for the inlet duct 10 and the control cone 13, to allow air to be supplied at different temperatures and velocities if necessary. However, for many products, air is supplied at the same velocity and pressure to both the inlet duct 10 and the stabilising device 13, in which case the blower may be connected to a single heater which supplies both the duct 10 and the device 13. Alternatively, the atmospheric air supplied to the blower 9 may be pre-heated by a heater 31.

The general sequence of operation of the apparatus, from start-up, is as follows:—first, the setting of the conical valve 7 and the stabilising device 13 are adjusted to suitable settings for the product to be processed, and a suitable temperature for the cyclone inlet air is selected, based on data acquired from previous processing runs for that product.

Initially, the blower 9 is started to duct air to the inlet duct 10 and to the airflow stabilising device 13; if necessary, one or both streams of air are heated using the air heaters 26 and/or 27, or the heater 31. When the temperature monitors inside the cyclone indicate that the cyclone has reached the desired operating temperature, the product to be processed is fed into the inlet duct air stream through the device 11. At first, a slow feed rate is used, and as product starts to leave the cyclone through the gap X, the feed rate is gradually increased to the normal processing rate for that product.

The product being processed is swept into the cyclone by the stream of the air through the inlet duct 10, and travels in a substantially spiral path around the interior of the cyclone, as described above. The fully processed product leaves the cyclone through the gap X.

The drawings illustrate a single pass through a single cyclone only, but it will be appreciated that multiple passes can be made through a single cyclone, simply by returning the processed products from collection point 28 to product supply 29. Alternatively, two or more cyclones (of the same or different specification) may be used in series and/or in parallel.

The above described apparatus may be varied in a number of ways:

1. The inlet air duct 10 may enter the cyclone at a point lower down the wall of the cyclone; the lower the point of entry, the shorter the dwell time of the product in the cyclone.

2. The inlet of the exhaust duct 8 and the associated core 5 can be offset from the longitudinal axis of the cyclone; the longitudinal axis of the duct 8 and core 5 may be parallel to, but horizontally offset from, the longitudinal axis of the cyclone.

3. Product to be processed can be fed into the cyclone entrained in the air stream entering through the airflow stabiliser device 13, rather than in the air stream entering through the inlet duct 10. With this method, air is still introduced into the cyclone through the inlet duct 10, but product is not fed into their air stream through the device 11, but through an equivalent device (not shown) located on the airline between the blower 9 and the device 13.

This method is particularly suitable for the processing of small experimental amounts of product.

4. The bottom of the cyclone may be closed apart from the device 13. In this case, rather than processed product leaving the cyclone through the gap X, the product is withdrawn from the cyclone through one or more outlets (not shown) formed in the wall of the frustro-conical portion 4 adjacent the bottom of the cyclone.

5. The wall of the frustro-conical portion 4 may be provided with a series of product withdrawal ports spaced vertically down the length of the portion, so that particles may be removed from the cyclone at any of a selection of different particles sizes.

The dimensions and proportions of the cyclone and other apparatus may be varied widely, to suit the type and volume of product to be processed. Typical dimensions of a cyclone to be used for processing foodstuffs and other organic materials, including sawdust, at a rate in the range 50–400 kilograms of water evaporated per hour are as follows:

Height of the cylindrical portion 3—1.5 m

Height of the frustro-conical portion 4—1.75 m

Diameter of the cylindrical portion 3—1.1 m

Diameter of the lower end of the frustro-conical portion 4—80 mm

Total volume of cyclone—2 cubic metres

Ratio of the volume of the cylindrical portion 3 to the frustro-conical portion 4—2.5:1.

Included angle at base of frustro-conical portion 4—in the range 28° to 40°, preferably 34°.

Width of annular gap X in the range 5 mm–15 mm.

Diameter of the bore 15—50 mm

Diameter of the cylindrical core 5—460 mm.

The diameter of the cylindrical core 5 is in the range 25 percent to 90 percent of the diameter of the cylindrical portion 3.

The operating conditions for a cyclone of the above described dimensions would of course vary with the product to be processed, but typically would be as follows:

Velocity of inlet air through duct 10 and through the stabilising device 13: 35 m per second–120 m per second. Even higher velocities may be used for some product or to clean out the interior of the cyclone. However, the preferred velocity range for most product is 65–85 m per second.

Pressure of the inlet air—up to 1.8 bars above atmospheric pressure.

Temperature of the inlet air—in the range ambient—80° Centigrade.

The above described apparatus has been found suitable for processing a very large range of materials, including the following:—marine products such as shellfish meat and shellfish shells, fish waste, fish and seaweed;

Cereal products such as wheat, maize, barley, brewers spent grain, stillage, gluten and flour, vegetables and herbs;

fruit and nuts;

wastes and nonbiological materials such as sawdust, newsprint, straws, bark, coal, concrete, feldspar, glass, clay and stone;

animal products such as antlers, antler velvet, bone, bone marrow, cartilage and eggs.

Liquid or semi liquid products such as egg white or gluten also can be processed successfully.

Examples of processing conditions for specific products:

EXAMPLE 1

Pre-blanched Swede

Initial moisture content—89%

Final moisture content of powder—8%

Feed rate into cyclone—62 kg per hour

Processed product (powder) recovered from cyclone—9.5 kg per hour

Temperature of air supplied to duct 10 and device 13—75° Centigrade

Velocity of air supplied to duct 10 and device 13—95 m per second

Air volume supplied to duct 10 and device 13—2.360 cubic metres per second

EXAMPLE 2

Seaweed (*Macrocystis* sp.)

Initial moisture content—86 percent.

Final moisture content—8.2%.

Feed rate into cyclone—5.83 kg per minute.

Processed product recovered from cyclone—0.816 kg per minute.

Water evaporated—5.01 kg per minute.

Temperature of air supplied to duct 10 and device 13—85° Centigrade.

Velocity of air supplied to duct 10 and device 13—85 m per second.

Air volume supplied to duct 10—2.36 cubic metres per second.

EXAMPLE 3

Sawdust initial moisture content—55 percent final moisture content—16 percent feed rate into cyclone—7.3 kg per minute processed product recovered from cyclone—3.79 kg per minute water evaporated—3.5 kg per minute temperature of air supplied to duct 10 and device 13—70° Centigrade Velocity of air supplied to duct 10 and device 13—95 m per second air volume supplied to duct 10—2.36 cubic metres per second.

What is claimed is:

1. Milling and drying apparatus incorporating at least one cyclone, said cyclone comprising:

an upper cylindrical portion which opens into the wider end of a lower frustro-conical portion, with the longitudinal axes of said upper and lower portions aligned;

a primary air inlet into the cyclone arranged such that the inlet air is substantially tangential to the circumference of the cyclone;

an exhaust outlet at or adjacent the top of the cylindrical portion;

a control valve associated with said exhaust outlet and capable of partially or completely shutting off said exhaust outlet;

a secondary air inlet associated with the narrow end of the frustro-conical portion and provided with an air flow stabilising device which is adapted to admit a stream of air substantially along the longitudinal axis of the cyclone;

a product inlet device arranged to supply product to be processed in the cyclone into the air supplied to either the primary or the secondary air inlets;

an air supply means connected to the primary air inlet and to the secondary air inlet;

air heating means adapted to heat air supplied to, and/or air supplied from, said air supply means;

means for recycling all or part of the air exhausted from the cyclone through the exhaust outlet to said air supply means, wherein said means for recycling incorporates at least one monitor for measuring the humidity and the temperature of the air exhausted from the cyclone, and a valve for adjusting the proportion of the exhaust air directed to the air supply means in response to the monitor readings, and means for withdrawing processed product from the cyclone.

2. The milling and drying apparatus as claimed in claim 1, wherein said air flow stabilising device is arranged to be movable into and out of the narrow end of the frustro-conical portion.

3. The milling and drying apparatus as claimed in claim 2 wherein said air flow stabilising device has an outer wall which is frustro-conical in shape and an interior bore through which air is supplied in use; said air flow stabilising device being dimensioned and arranged such that the narrow end of said frusto-conical outer wall is insertable in the narrow end of said frustro-conical portion of the cyclone.

4. The milling and drying apparatus as claimed in claim 3 wherein said interior bore is arranged to be movable into and out of the narrow end of the frustro-conical portion independently of the frustro-conical outer wall of said air flow stabilising device.

5. The milling and drying apparatus as claimed in claim 2 or claim 4, wherein said means of withdrawing processed product from the cyclone comprises an annular gap at the narrow end of the frustro-conical portion between the wall of the frustro-conical portion and the air flow stabilising device.

6. The milling and drying apparatus as claimed in claim 4, further comprising a cylindrical core mounted within the upper cylindrical portion of the cyclone, with the longitudinal axis of the cylindrical core parallel to, or coincident with, the longitudinal axis of said upper cylindrical portion.

7. The milling and drying apparatus as claimed in claim 1 wherein said means of withdrawing processed product from the cyclone comprises one or more outlets formed in the wall of said frusto-conical portion of the cyclone.

8. The milling and drying apparatus as claimed in claim 1, further comprising a cylindrical core mounted within the upper cylindrical portion of the cyclone, with the longitudinal axis of the cylindrical core parallel to, or coincident with, the longitudinal axis of said upper cylindrical portion.

9. The milling and drying apparatus as claimed in claim 8 wherein said cylindrical core surrounds the exhaust outlet.

10. The milling and drying apparatus as claimed in claim 9 wherein the diameter of the cylindrical core is in the range 25% to 90% of the diameter of the cylindrical portion.

11. The milling and drying apparatus as claimed in claim 1 wherein the ratio of the volume of the cylindrical portion of the cyclone to the frustro-conical portion of the cyclone is 2.5:1.

12. The milling and drying apparatus as claimed in claim 1 further including dust collection means through which exhaust air is passed before it is released to atmosphere.

13. The milling and drying apparatus as claimed in claim 1, which incorporates at least two cyclones and which includes means for collecting product from a first cyclone and passing that product to the or each of the other cyclones in sense.

14. A method of operating the milling and drying apparatus as claimed in claim 1, including the steps of:

supplying air from the air supply means to both the primary air inlet and to the air flow stabilising device;

supplying product to be processed via the product inlet device to the air supplied to the primary air inlet;

regulating the air supplied to the air flow stabilising device as necessary to produce a substantially stable secondary vortex with the cyclone;

monitoring the temperature and humidity of the exhaust air passing through the exhaust outlet and recycling all or a proportion of the exhaust air to the inlet of the air supply means, depending upon the monitor readings.

* * * * *

UNITED STATES PATENT AND TRADEMARK OFFICE

CERTIFICATE OF CORRECTION

PATENT NO. : 6,993,857 B2
APPLICATION NO. : 10/362408
DATED : February 7, 2006
INVENTOR(S) : Graeme Douglas Cole It is certified that error appears in the above-identified patent and that said Letters Patent is hereby corrected as shown below:

CLAIM 13:

Column 11, line 17, delete “in sense” and replace it with --in series--.

Signed and Sealed this

Twenty-second Day of August, 2006

JON W. DUDAS
*Director of the United States Patent and Trademark Office*